US006249210B1

(12) United States Patent
Hofsäss

(10) Patent No.: US 6,249,210 B1
(45) Date of Patent: Jun. 19, 2001

(54) SWITCH HAVING AN INSULATING SUPPORT

(76) Inventor: Marcel Hofsäss, Höfener Strasse 29, 75305, Neuenbürg (DE)

( * ) Notice: Subject to any disclaimer, the term of this patent is extended or adjusted under 35 U.S.C. 154(b) by 0 days.

(21) Appl. No.: 09/416,608

(22) Filed: Oct. 12, 1999

(30) Foreign Application Priority Data

Oct. 13, 1998 (DE) ..... 198 47 208

(51) Int. Cl.[7] ..... H01H 37/14; H01H 61/02; H01H 37/52

(52) U.S. Cl. ..... 337/324; 337/77; 337/362; 337/333; 337/365; 337/372

(58) Field of Search ..... 337/324, 362, 337/388, 389, 397, 333, 342, 343, 365, 372, 375, 377, 380, 390, 391, 361, 52, 53, 85, 89, 100–102, 131, 135, 141, 77

(56) References Cited

U.S. PATENT DOCUMENTS

| | | | | |
|---|---|---|---|---|
| 2,139,921 | * | 12/1938 | Weinhardt | 200/138 |
| 2,503,008 | * | 4/1950 | Taylor | 200/138 |
| 3,443,259 | * | 5/1969 | Wehl et al. | 337/89 |
| 3,706,952 | * | 12/1972 | Alley | 337/348 |
| 3,959,762 | | 5/1976 | Senor . | |
| 4,319,214 | * | 3/1982 | Givler | 337/343 |
| 4,363,016 | * | 12/1982 | Unger | 337/56 |
| 4,389,630 | * | 6/1983 | Ubukata et al. | 337/363 |
| 4,620,175 | * | 10/1986 | Karr et al. | 337/343 |
| 4,636,766 | | 1/1987 | Carbone et al. . | |
| 4,843,363 | * | 6/1989 | Ubukata et al. | 337/94 |
| 4,862,132 | * | 8/1989 | Hollweck | 337/102 |
| 5,212,465 | * | 5/1993 | Mizutani et al. | 337/368 |
| 5,309,131 | * | 5/1994 | Hofsass et al. | 337/102 |
| 5,367,279 | * | 11/1994 | Sakai | 337/104 |
| 5,892,429 | | 4/1999 | Hofsäss . | |

FOREIGN PATENT DOCUMENTS

| | | | | |
|---|---|---|---|---|
| 2113388 | | 10/1971 | (DE) . | |
| 196 04 939 A1 | | 8/1997 | (DE) . | |
| 1-246737 | * | 10/1989 | (JP) | 337/362 |
| 10-74438 | * | 3/1998 | (JP) | H01H/37/54 |

* cited by examiner

*Primary Examiner*—Leo P. Picard
*Assistant Examiner*—Anatoly Vortman
(74) *Attorney, Agent, or Firm*—Harness, Dickey & Pierce, P.L.C.

(57) ABSTRACT

A switch has an insulating support on which a first and a second external terminal are arranged, and a temperature-dependent switching mechanism that, as a function of its temperature, makes between the first and the second external terminal an electrically conductive connection for an electrical current to be conveyed through the switch, and having a switching member that changes its geometric shape in temperature-dependent fashion between a closed position and an open position and in its closed position carries the current, and an actuating member that is connected electrically and mechanically in series with the switching member. The first external terminal is connected to a planar cover electrode, to which the actuating member is fastened with its first end and on whose inner side is arranged a flat series resistor that is electrically connected between the first external terminal and the first end of the actuating member.

19 Claims, 5 Drawing Sheets

SWITCH HAVING AN INSULATING SUPPORT

BACKGROUND OF THE INVENTION

1. Field of the Invention

The present invention concerns a switch having an insulating support on which a first and a second external terminal are arranged, and having a temperature-dependent switching mechanism that, as a function of its temperature, makes between the first and the second external terminal an electrically conductive connection for an electrical current to be conveyed through the switch, and comprises a switching member that changes its geometric shape in temperature-dependent fashion between a closed position and an open position, in its closed position the switching member carrying the current, an actuating member being provided that is connected electrically and mechanically in series with the switching member.

2. Related Prior Art

A switch of this kind is known from U.S. Pat. No. 4,636,766.

The known switch comprises, as the switching member, a U-shaped bimetallic element having two legs of different lengths. Attached to the long leg is a movable contact element that coacts with a switch-mounted countercontact that in turn is connected in electrically conductive fashion to one of the two external terminals.

The shorter leg of the U-shaped bimetallic element is attached to the free end of an actuating member, configured as a lever arm, that at its other end is joined immovably to the housing and is connected in electrically conductive fashion to the other of the two external terminals. The actuating member is a further bimetallic element that is matched with the U-shaped bimetallic element in such a way that when temperature changes occur, the two bimetallic elements deform in opposite directions and thus maintain the contact pressure between the movable contact element and the housing-mounted countercontact.

This switch serves as an interrupter for high currents which result in considerable heating of the bimetallic elements through which they flow, so that ultimately the movable contact element is lifted away from the fixed countercontact. Ambient temperature influences are compensated for by the aforementioned oppositely directed shaping of the bimetallic elements.

The principal disadvantage of this design is that two bimetallic elements, whose temperature characteristics must exactly match with one another, are required; this is difficult and cost-intensive to implement in design terms. In order to compensate for production tolerances, the known switch is moreover mechanically adjusted after assembly, which constitutes a further disadvantage.

Since the two bimetallic elements are of very different geometrical configuration, they also have different long-term stability properties, so that readjustment would in fact be necessary from time to time. This is no longer possible during service, however, the overall result being that long-term stability and therefore operating reliability leave much to be desired.

A further disadvantage with this design is the large overall height necessitated by the U-shaped bimetallic element.

Lastly, a further disadvantage with this switch is that it automatically closes again after cooling off, i.e. exhibits no current dependency that prevents re-closing and thus reactivation of the electrical device protected by the switch.

Switches with current dependency are commonly known; with them, a self-hold resistor is connected between the two external terminals, in parallel with the temperature-dependent switching mechanism. When the switch is in the closed state, the self-hold resistor is electrically short-circuited through the switching mechanism, so that it carries no current. If the switching mechanism opens, however, a residual current flows through the self-hold resistor which thereby heats up, as a function of the applied voltage and its resistance value, to such a point that it holds the temperature-dependent switching mechanism at a temperature above the response temperature, so that it remains open.

The prior art discloses a lot of designs for the self-hold resistor in which a block-shaped PTC resistor is used, resulting in an increase in the geometrical dimensions as compared to a switch exhibiting no current dependency.

A further disadvantage that is associated with the known switches having current dependency consists in the design outlay, which results in cost-intensive switches that are difficult to assemble.

A further disadvantage associated with the switch mentioned at the outset is the fact that the threshold value of the current that results in opening of the switch is determined by the ohmic resistance of the bimetallic element, so that it is difficult to implement different switching current values.

It is already known from the prior art, however, to adjust the current dependency by using a dropping or heating resistor that is connected electrically in series with the temperature-dependent switching mechanism. In the known switches, however, an actuating member in the form of a spring snap disk, etc., through which the electrical current flows, is connected in parallel with the switching member. In other words, in current-dependent switches with a dropping resistor the bimetallic element experiences no current, and the operating current of the electrical device being protected is conveyed through a separate spring element. By selecting the resistance value of this dropping or series resistor, the switching current value can now be adjusted accurately and reproducibly.

It is also the case with the known switches having a series resistor that the design outlay is disadvantageous and assembly of the switches is cost-intensive and time-consuming.

A further current-dependent switch known from EP 0 103 792 B1 has as the switching member a bimetallic spring tongue that is attached to one external terminal and carries at its free end a movable contact element that coacts with a countercontact that is arranged at the free end of an elongated spring element that is attached at the other end to the other external terminal, so that the current flows through the series circuit made up of the spring element and bimetallic spring tongue.

The elastic mounting of the countercontact ensures in this case that there is little mechanical load on the bimetallic spring tongue, since the countercontact deflects in limited fashion when the bimetallic spring tongue changes its geometric shape as a result of a temperature change. This prevents irreversible deformations of the bimetallic spring tongue that might result in a shift in the switching temperature. One disadvantage of this switch is the fact that during the transition from the closed to the open position, the bimetallic spring tongue, like all bimetallic elements, passes through a "creep" phase in which the bimetallic element deforms in creeping fashion in response to an increase or decrease in temperature, but without yet snapping over from its, for example, convex low-temperature position into its concave high-temperature position. This creep phase occurs whenever the temperature of a bimetallic element approaches the kickover temperature either from above or from below, and results in appreciable conformational changes. In addition, the creep behavior of a bimetallic element can also change, in particular, as a result of aging or long-term operation.

During the opening movement, creep can result in a weakening of the pressure of the contact against the countercontact, thus causing undefined switching states. During the closing movement, the contact can gradually approach the countercontact during the creep phase, which can create the risk of arcing.

The problems associated with the creep behavior of a bimetallic element are solved, in a current-dependent switch such as described in the aforementioned U.S. Pat. No. 4,636,766 or in EP 0 103 792, by the fact that the bimetallic spring tongues are equipped with dimples with which the creep phase is not completely but at least for the most part suppressed. These dimples or other mechanical impressions provided onto the bimetallic element to suppress the creep phase are complex and expensive features which moreover greatly reduce the service life of these bimetallic elements. A further disadvantage of the requisite dimple is that not only different material compositions and thicknesses, but also different dimples, must be used for various power classes and response temperatures.

SUMMARY OF THE INVENTION

In view of the above, it is an object of the present invention to equip a switch of the kind mentioned at the outset, which avoids the aforesaid disadvantages, with a current dependency in the context of an economical and simple design; the switch is to have a compact construction, excellent operating reliability, and a long service life.

In the case of the switch mentioned at the outset, this object is achieved in that the first external terminal is connected to a planar cover electrode, to which the actuating member is fastened with its first end and on whose inner side is arranged a flat series resistor that is electrically connected between the first external terminal and the first end of the actuating member.

The object underlying the invention is completely achieved in this fashion.

Specifically, the inventor of the present Application has recognized that it is possible, with a switch of the generic type, to provide a flat cover electrode on whose inner side is arranged a flat series resistor that lies between the first external terminal and the first end of the actuating member. The series resistor has almost no perceptible effect on overall height, since it can be configured, for example, as a film resistor that makes almost no contribution to any increase in the thickness of the cover electrode.

It is particularly preferred in this context if the actuating member is a spring element whose displacing force or resilience is largely independent of temperature, and if the actuating member has a temperature-dependent displacing force or resilience that, in its creep phase, is greater than the displacing force of the spring element.

The inventor of the present application has recognized that the mechanically and electrically parallel arrangement, known for example from DE 21 21 802 C, of the temperature-neutral spring element and switching member can be converted into an electrical and mechanical series circuit and used in the new switch in order to combine a number of further advantages in the new switch.

The reason is that because of the mechanical series circuit, i.e. the fact that the spring force of the spring element coacts with that of the switching member, the creep phase of the switching member can be compensated for. When the geometry of the switching member changes during the creep phase, this is immediately compensated for by the spring element. It is therefore now possible for the first time, even in the case of a switch having a switching member through which current flows (which can be a bimetallic or trimetallic element), to allow a large creep phase for the switching member, since the spring element can compensate for the "undesired" changes in shape during the creep phase. This means, however, that a more easily manufactured and therefore more economical switching member, which moreover has a longer service life, can be used, since dimpling can be largely dispensed with and a greater hysteresis thus becomes permissible, so that the creep phase can be maximally utilized.

As a result, however, not only are fewer geometrical demands placed on the switching member, but there are also fewer requirements in terms of the spring element, since the latter now needs only to ensure that the switching member remains, below its kickover temperature (i.e. during the creep phase), in electrical contact with one of the external terminals. Switch types that differ in terms of power class and response temperature can now be designed with substantially the same spring element but different switching members; these components of the switching mechanism are subject to much fewer geometrical and mechanical conditions, so that all in all they can be manufactured more easily and more economically.

In terms of the service life of the switching member, the advantages obtained here are the same as in the case of the loosely laid-in bimetallic snap disk disclosed by DE 21 21 802 C. All in all, with the new switch more emphasis can be placed on electrical properties and on switching temperature; for the first time in the art, the mechanical spring force of the switching member plays a subordinate role, since it needs to be only sufficient that the switching member is not too greatly compressed by the spring element. The switching process itself is effected, after completion of the creep phase, solely by the switching member, which is now always preloaded in its creep position. This preloaded switching member exhibits a number of further advantages: for example, it does not vibrate in a magnetic field and it presents no risk of arcing, since any gradual opening or closing of contacts is prevented by the preload.

This means that only a very slight dimpling of the bimetallic element, which merely needs to ensure the snap effect for sudden contact separation, is necessary. A more pronounced dimpling, as was used hitherto to reinforce or suppress the creep phase, is no longer necessary. Mechanical loads are thereby reduced, and the service life and the reliability and reproducibility of the switching point are thus greatly increased.

The temperature-neutral spring element no longer exerts on the bimetallic element any pressure which prevents its deformation; instead, in the creep phase it compensates for the deformation of the bimetallic element by way of its own deformation, in such a way that the movable contact element and fixed countercontact remain securely in contact with one another so as to ensure a low contact resistance. Below the switching temperature, the contact pressure remains constant largely independent of temperature.

The creep phase of the bimetallic element is thus no longer suppressed as in the prior art, but rather, so to speak, compensated for, since the bimetallic element can deform in almost unimpeded fashion in the creep phase, the changes in geometry being compensated for by the spring element in such a way that the switch remains securely closed.

For this purpose, the temperature-dependent displacing force of the bimetallic element is selected so that in the creep phase it is greater than the largely temperature-neutral displacing force of the spring element, which thus simply "guides" the accordingly "rigid" bimetallic element.

One great advantage of the new switch lies in its simple design: in addition to a housing-mounted countercontact, only one bimetallic element is required, and the spring element is temperature-neutral and thus economical. All in all, although the bimetallic element and spring element do need to be coordinated with one another in terms of displacing force, they no longer must be additionally coordinated in terms of their temperature behavior, since the switching mechanism, so to speak, aligns itself. This makes possible one standard spring element for all temperature ranges, thus achieving a substantial rationalization effect. This design moreover makes it possible to achieve a low overall height, and individual readjustment is not necessary for different switching temperatures: the bimetallic element merely needs to be designed with the same spring properties but different switching temperatures.

A further advantage is the fact that tolerances and fluctuations in switching temperature are compensated for by the guidance achieved by way of the temperature-neutral spring element.

It is preferred in this context if the spring element and the switching member are substantially flat, sheet-like parts that extend away from their joining point in a V-shape toward the same side.

The advantage of this feature is that overall height is greatly reduced as compared to the generic switch, and a lesser longitudinal extension is also achieved because of the "folded-back" free end of the switching member.

It is further preferred if there is arranged on the inner side of the cover electrode an insulating film on which is arranged a resistive path that is connected at one end to the first external terminal and at the other end to a contact surface with which a contact region on the spring element is in contact.

This feature is advantageous in terms of design: when the cover electrode is laid onto the switch that has already been equipped with the switching mechanism, the contact surface comes into direct contact with the contact region, so that the electrical connection is made, so to speak, together with the mechanical join between the cover electrode and the housing.

It is preferred in this context if the spring element is configured at its first end in a T-shape, rests with that T-shaped end on the insulating support, and has at that T-shaped end a contact region that is in contact with the contact surface of the series resistor.

This once again advantageously simplifies assembly of the new switch, since the switching mechanism, so to speak, automatically aligns itself in the interior of the insulating support when the T-shaped end is laid onto the insulating support.

It is preferred in general if the second external terminal is connected to a bottom electrode that coacts with a movable contact element that is provided on the switching member, and if at least one PTC module is clamped between the bottom electrode and the cover electrode.

The advantage here is that the PTC module implements a self-hold function, contacting to the PTC module being accomplished by simple clamping, i.e. being automatically implemented when the switch is mechanically assembled.

On the other hand, it is preferred if the second external terminal is connected to a bottom electrode that coacts with a movable contact element that is provided on the switching member, and if a PTC module is clamped between the bottom electrode and the T-shaped end of the spring element.

The advantage here is that once again simple contacting to the PTC module can be achieved; when the switching mechanism is in the open state, this PTC module can now be connected in series with the series resistor, so that different resistance conditions can result. It is particularly advantageous, however, that the T-shaped end of the spring element now embodies several functions: it provides on the one hand mechanical retention of the switching mechanism in the insulating support, and on the other hand electrical connection both to the series resistor and to the PTC module that acts as the self-hold resistor. All that is necessary for this, however, is to provide, in the region of this T-shaped end of the spring element, a surface finish such that electrical contacting is possible merely by way of pressure and contact; lesser requirements apply to the other surfaces, thus contributing to reduced cost.

It is preferred in this context either if a transversely oriented cavity, arranged between the external terminals, is provided for the PTC module, or if two lateral cavities are provided next to the switching mechanism for two PTC modules.

The advantage here is that as compared to a switch without a PTC module, all that is needed is a slight increase in the longitudinal extension in the case of the transversely oriented cavity, or in the transverse dimensions in the case of the two lateral cavities; the other dimensions can be maintained. These features thus also contribute to generally small dimensions for the new switch.

The design variant with the two lateral cavities is especially preferable when, in the interest of greater current capacity, a larger current passthrough area is necessary for the self-hold resistor that is now constituted by two PTC modules.

Further advantages are evident from the description of the appended drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

Embodiments of the invention are shown in the drawings and will be explained in more detail in the description below. In the drawings.

DETAILED DESCRIPTION OF PREFERRED EMBODIMENT

Figure 1:
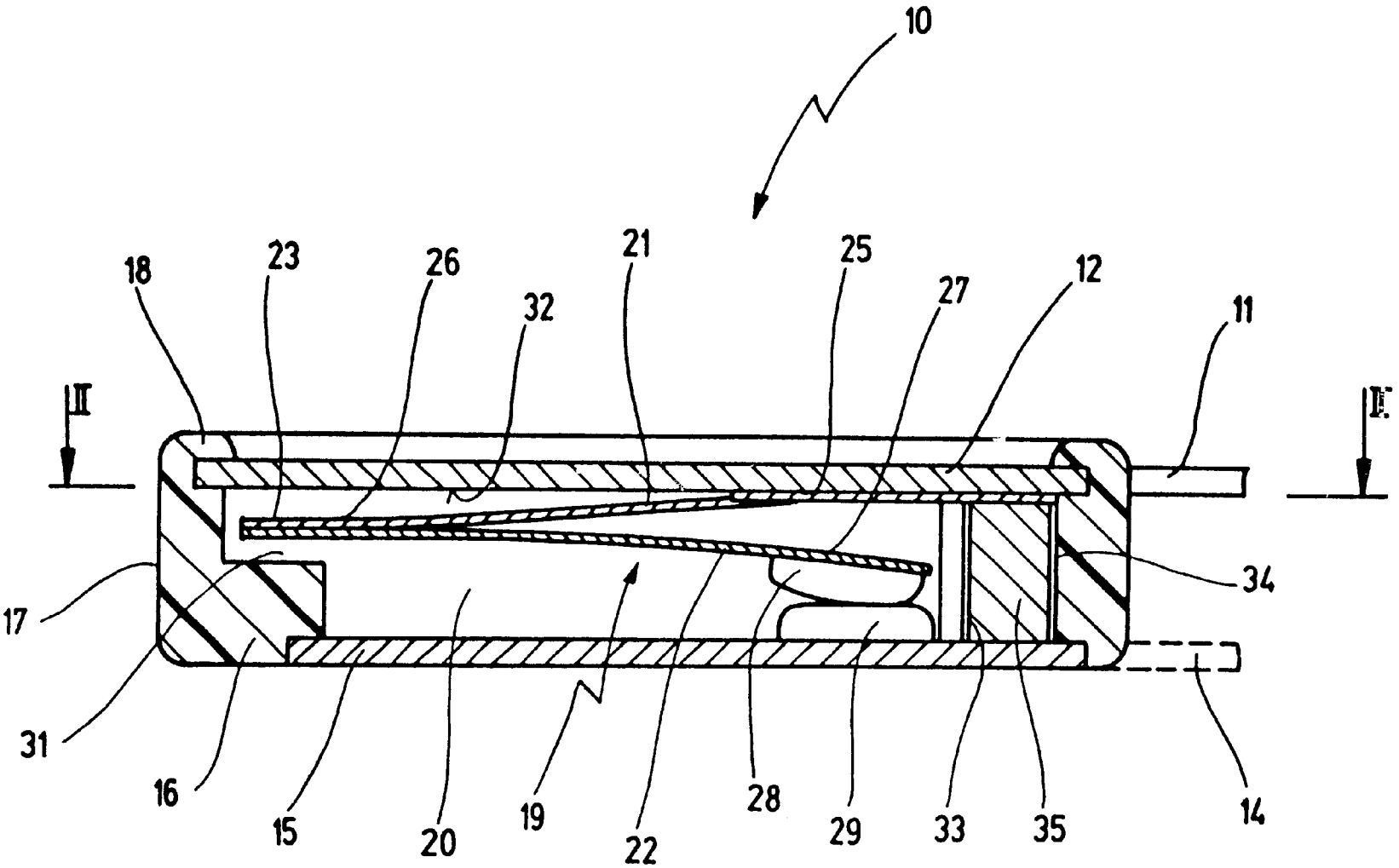
FIG. 1 shows a longitudinal section through the new switch along line I—I of FIG. 2.

In FIG. 1, reference numeral 10 generally designates a new switch, which is shown in schematic longitudinal section.

The new switch 10 has a first external terminal 11 that is joined integrally to a flat cover electrode 12. Also provided is a second external terminal 14 that is configured integrally with a bottom electrode 15. Cover electrode 12 and bottom electrode 15 are retained on an insulating support 16 that holds cover electrode 12 and bottom electrode 15 spaced apart parallel to one another.

While insulating support 16 can theoretically be open laterally, FIG. 1 shows an embodiment in which insulating support 16 comprises a cup-shaped lower housing part 17 that is configured around bottom electrode 15, by injection embedding or encapsulation, in such a way that bottom electrode 15 is an integral constituent of lower housing part 17. Lower housing part 17 is closed off by cover electrode 12 and is held in lossproof fashion by a hot-welded rim, indicated at 18, of insulating support 16.

A temperature-dependent switching mechanism 19 is arranged between cover electrode 12 and bottom electrode 15 in an interior space of insulating support 16. Switching mechanism 19 comprises a mechanical and electrical series circuit made up of a spring element 21 and a switching member 22, which are joined to one another by way of a join arranged at 23. In the present case, switching member 22 is a bimetallic element.

Spring element 21 has a largely temperature-independent displacing force or resilience; in the context of the present invention, this means that the displacing force or spring force of spring element 21 does not change appreciably within the allowable operating temperature range of switch 10. The displacing force of the bimetallic element, on the other hand, is highly temperature-dependent, and even in the so-called creep phase is already sufficient that spring element 21 cannot exert any pressure capable of preventing deformation of the bimetallic element on the bimetallic element, which in this spring system is therefore to be regarded as rigid at constant temperature.

The spring element 21 is in contact at its first, T-shaped end 25 with cover electrode 12, and at its second end 26 leads into join 23 to switching member 22. Switching member 22 carries at its free end 27 a movable contact element 28 that coacts with a switch-mounted countercontact 29 that is configured on bottom electrode 15.

Bottom electrode 15 is partially overlapped by an insulating bridge 31 that prevents join 23 from moving so far downward, when switching mechanism 19 opens, that it undesirably comes into contact with bottom electrode 15.

In a manner yet to be described, cover electrode 12 is equipped on its inner side 32 with a series resistor that is connected electrically between first external terminal 11 and T-shaped end 25 of spring element 21.

In addition, a PTC module 33, which is arranged in a cavity 34 and acts as self-hold resistor 35, is clamped between bottom electrode 15 and T-shaped end 25.

When switch 10 is in the closed state shown in FIG. 1, self-hold resistor 35 is bypassed by switching mechanism 19, i.e. carries no current. When movable contact element 28 then lifts away from fixed countercontact 29 as a result of a rise in temperature, a residual current flows from second external terminal 14, via bottom electrode 15 and through self-hold resistor 35, into T-shaped end 25, and from there via the series resistor into cover electrode 12 and from there into first external terminal 11, so that there exists between the two external terminals 11, 14 a series circuit, made up of the series resistor and self-hold resistor, that is heated by a residual current to the point that it holds switching mechanism 19 in the open state.

Figure 2:
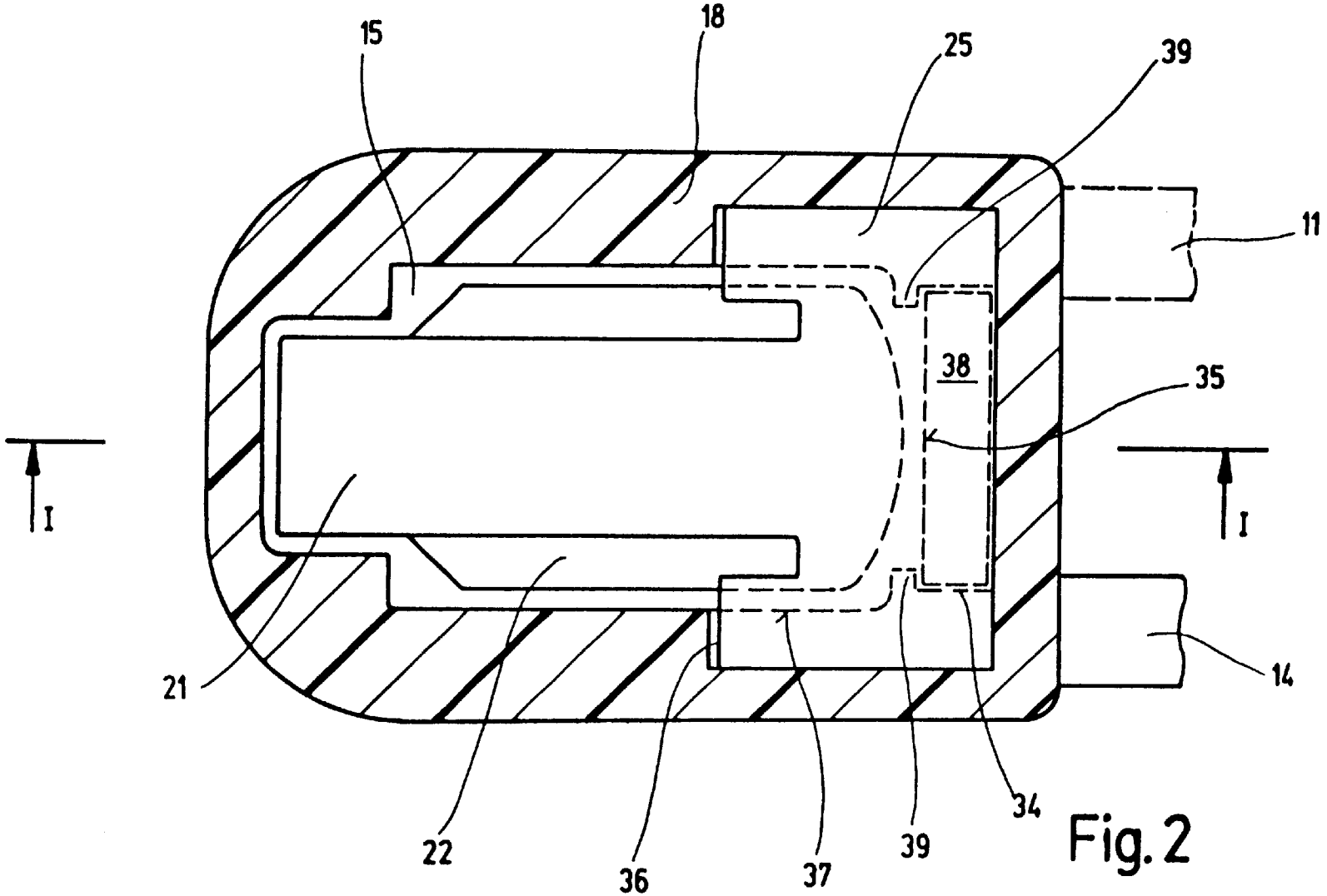
FIG. 2 shows a plan view of the switch according to FIG. 1, in a sectioned representation along line II—II of FIG. 1.

In FIG. 2, the switch of FIG. 1 is shown in section along line II—II of FIG. 1. It is evident that T-shaped end 25 of spring element 21 lies on a base 36 of insulating support 16 that is arranged below cutaway rim 18. The outline of base 36 is labeled 37.

Indicated beneath T-shaped end 25 in cavity 34 is self-hold resistor 35, which is in contact from below with a contact region, labeled 38, of T-shaped end 25 of spring element 21. Provided on the other side of T-shaped end 25, i.e. in the plan view of FIG. 2, is a further contact region 38 by way of which contact is made, in a manner yet to be described, with the series resistor.

Note also that base 36 is equipped with projections 39 with which self-hold resistor 35 is retained in cavity 34.

Figure 3C:
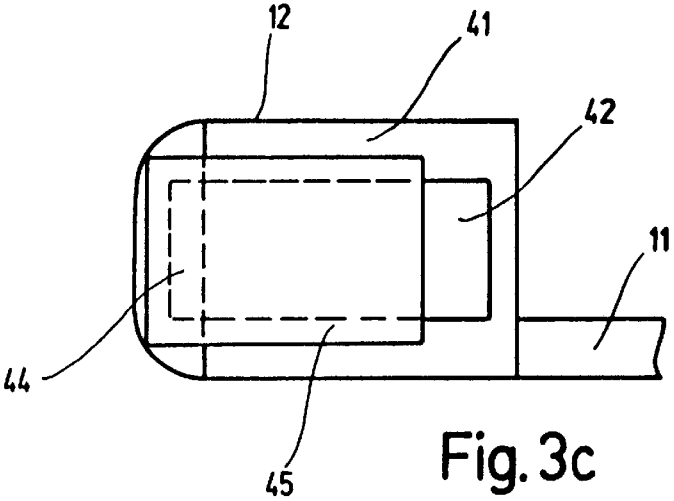
FIGS. 3*a* through 3*d* each show a plan view of the inner side of the cover electrode of the switch of FIGS. 1 and 2, at different stages in the installation and contacting of a series resistor.
Figure 3D:
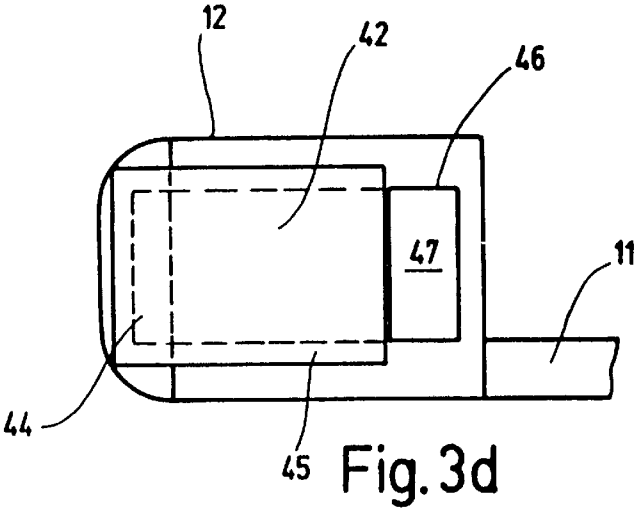
Figure 3B:
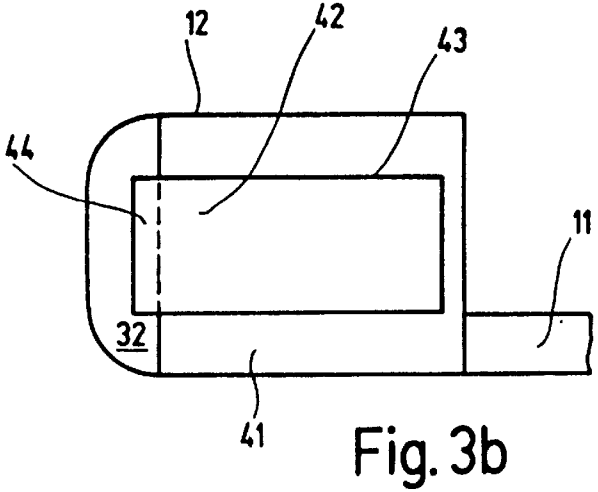
Figure 3A:
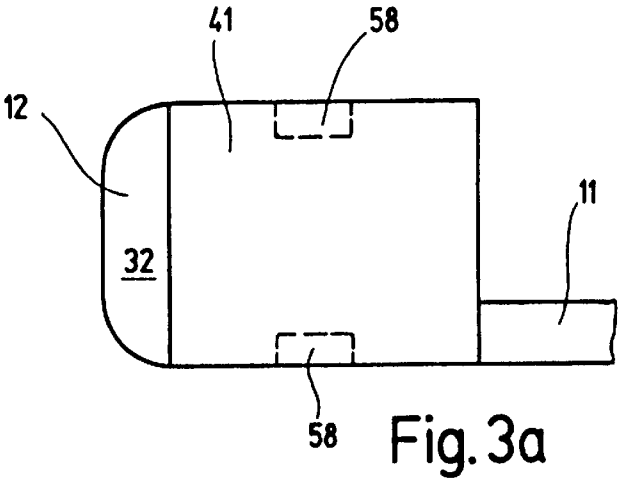

FIGS. 3*a* through 3*d* show production steps for the manufacture of cover electrode 12 equipped with a series resistor. In FIG. 3*a*, inner side 32 is first equipped with an insulating film 41, onto which (FIG. 3*b*) a resistive path 42, constituting series resistor 43, is then applied. Resistive path 42 overlaps insulating film 41 to the left in FIG. 3, thus creating a connection region 44 to inner side 32 of cover electrode 12, which is made of metal. In this fashion, first external terminal 11 is connected to series resistor 43.

As shown in FIG. 3*c*, a further insulating film 45 is laid over connection region 44 and over most of resistive path 42, leaving only a portion of resistive path 42 exposed on the right. A silver layer 46 constituting a contact surface 47 is then applied onto this exposed region of resistive path 42, as shown in FIG. 3*d*.

When cover electrode 12 of FIG. 3*d* is laid onto switch 10, which is shown in the open position in FIG. 2, contact surface 47 comes into contact with contact region 38, so that series resistor 43 is connected in series between first external terminal 11 and spring element 21.

The operating current of an electrical device being protected, which flows through switch 10 in the closed state, thus flows directly through series resistor 43, which heats up if the current is impermissibly high and delivers this ohmic heat directly into interior space 20 of switch 10; this causes switching mechanism 19 to open, and therefore contacts 28, 29 to open, as will now be explained with reference to FIGS. 4 through 6.

Figure 4:
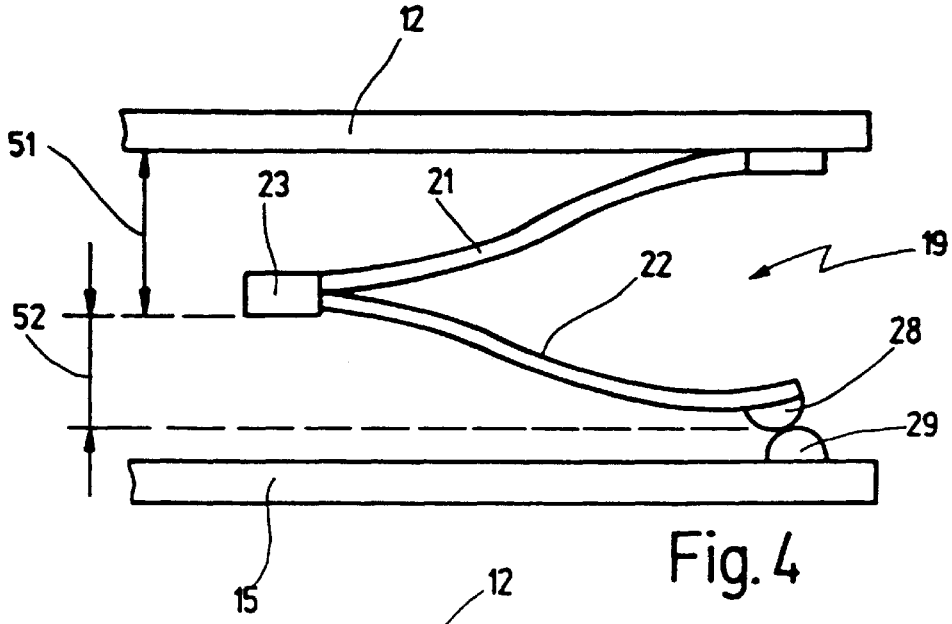
FIG. 4 shows the switching mechanism of FIG. 1 in a schematized, enlarged representation, the switching member being in the closed position.

FIG. 4 shows switching mechanism 19 of FIG. 1, schematically and at enlarged scale, in its closed position. Switching member 22 is so far below its kickover temperature that its creep phase has not yet begun. Switching member 22 presses join 23 upward in FIG. 4 against the force of spring element 21, thus establishing a spacing from cover electrode 12 indicated at 51, and a spacing from countercontact 29 indicated at 52.

Figure 5:
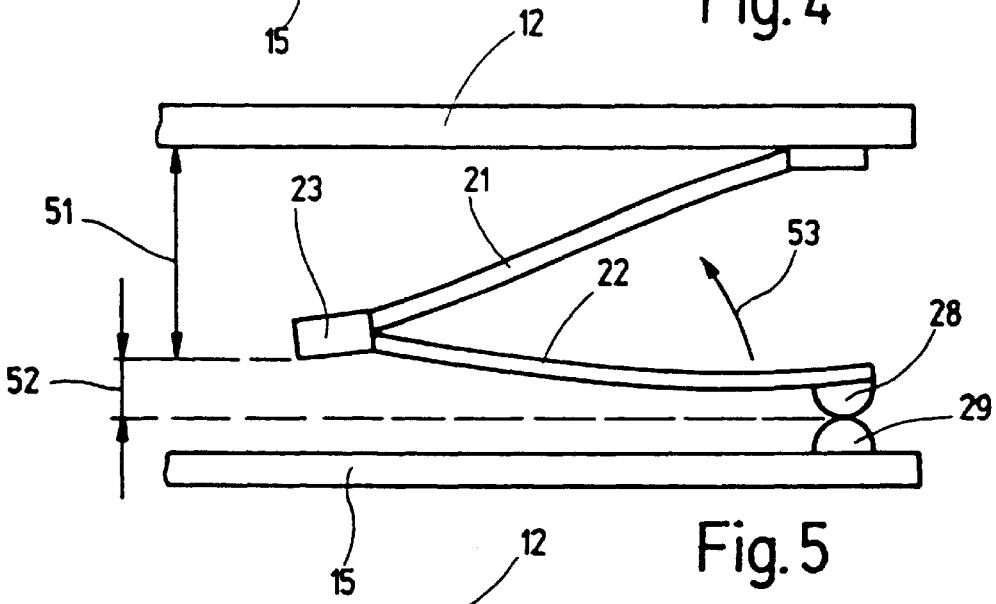
FIG. 5 shows a representation like FIG. 4, but during the creep phase of the switching member.

If the temperature of switching member 22 then rises, because of an increased current flow and the heating of series resistor 43 associated therewith or because of an increased outside temperature, initially the creep phase of switching member 22 then begins; in this, its spring force acting against the force of spring element 21 weakens, so that join 23 is moved downward in FIG. 4, as shown in FIG. 5. The displacing force of the bimetallic element is, however, still so great that the displacing force of spring element 21 is not sufficient to prevent the deformations that occur in the creep phase. Regardless of its changes in geometry in the creep phase, switching member 22 is to be regarded as rigid by comparison with spring element 21; the contact pressure is exerted solely by the displacing force of spring element 21.

Spacing 51 increases to the same extent that spacing 52 decreases. The mechanical series circuit made up of spring element 21 and switching member 22 continues, however, to push movable contact element 28 against countercontact 29. A comparison between FIGS. 4 and 5 reveals, however, that movable contact element 28 has shifted transversely in FIG. 5 with respect to countercontact 29. This friction is desirable, since the contact surfaces between contact element 28 and countercontact 29 are thereby cleaned, so that the electrical contact resistance is very low.

Figure 6:
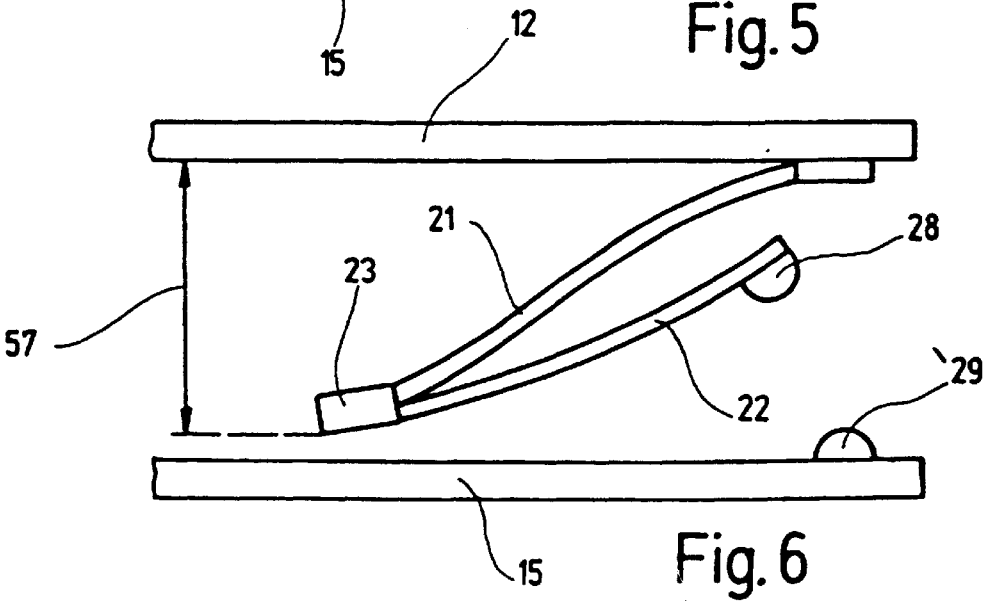
FIG. 6 shows a representation like FIG. 4, but with the switching member in its open position.

If the temperature of switching member 22 then increases further, it snaps in the direction of an arrow 53 into its open position shown in FIG. 6. Join 23 has moved even farther downward, and switching member 22 has lifted movable contact element 28 away from countercontact 29. A comparison between FIGS. 4 and 6 reveals that join 23 between cover electrode 12 and bottom electrode 15 has moved downward, while movable contact element 28 has moved upward in the opposite direction, so that the clearance between cover electrode 12 and bottom electrode 15 is, so to speak, utilized twice over.

It is also evident that spring element 21 and switching member 22 are flat, sheet-like parts that extend from their joining point in, so to speak, a V-shape to the same side, namely to the right. This "folded-back" arrangement of spring element 21 and switching member 22 results in a shortened configuration in the longitudinal direction, thus making possible a configuration that is not only flat but also relatively short.

Returning to FIG. 2, it may also be noted that cavity 34 and self-hold resistor 35 arranged therein result in only a slight increase in the length of the switch as compared to an embodiment without a self-hold resistor.

Figure 7:
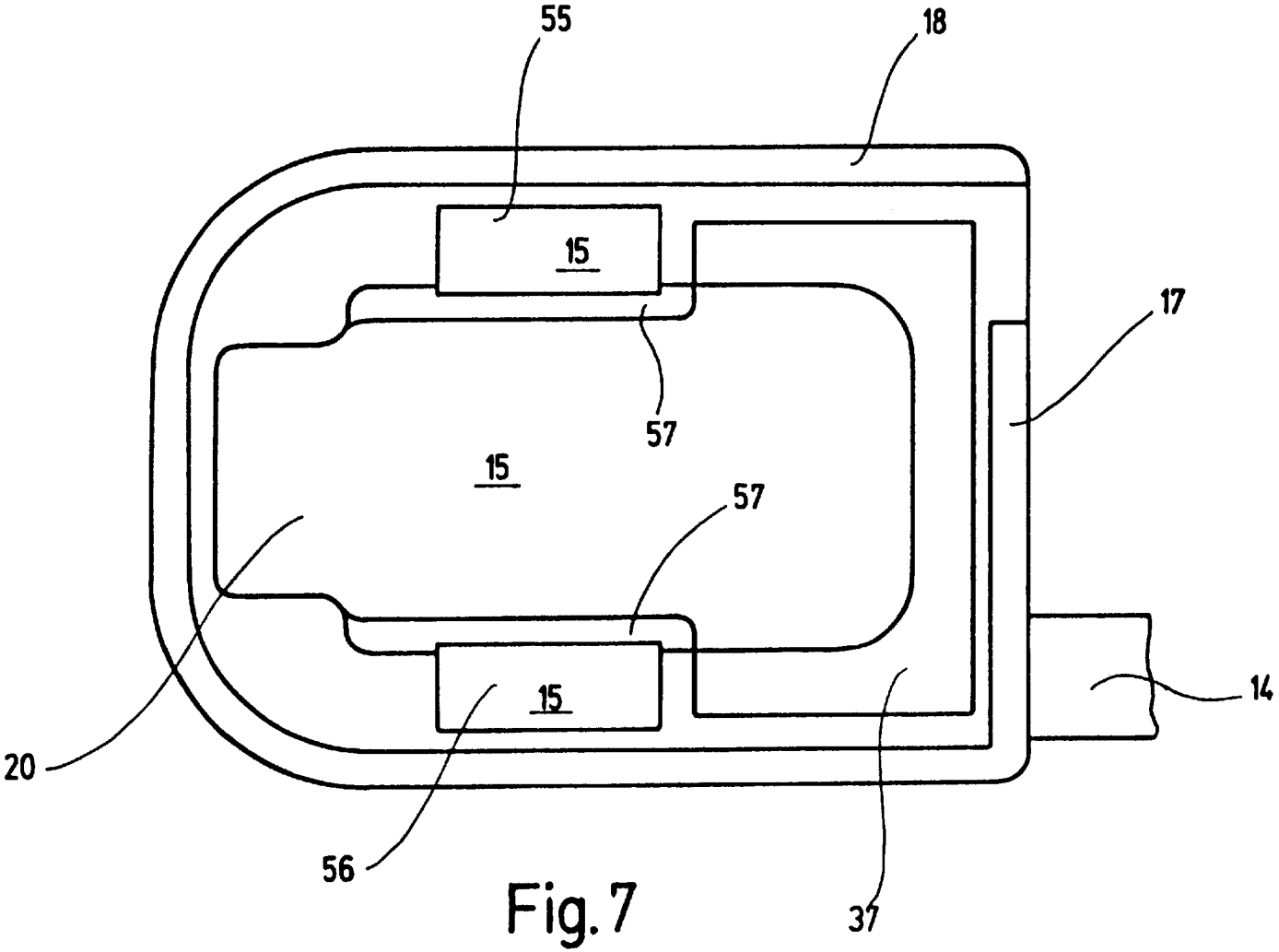
FIG. 7 shows a plan view of the insulating support of the switch according to FIG. 1, in a second embodiment having two cavities for two PTC modules.

If, however, even this slight increase in the lengthwise direction should be undesirable, it is also possible to arrange PTC modules in cavities laterally next to switching mechanism 19, as is evident from FIG. 7.

FIG. 7 shows a cup-shaped lower housing part 17 in plan view; only bottom electrode 15 has already been injection-embedded or encapsulated with its external terminal 14, but the switching mechanism itself and the PTC modules have not yet been set in place.

FIG. 7 shows base 37, on which T-shaped end 25 of switching mechanism 19 comes to rest when the latter is placed into interior space 20. Two cavities 55, 56, which extend downward as far as bottom electrode 15 and are open at the top, are provided laterally next to interior space 20 in lower part 17. Laterally inward, these cavities are surrounded by a base 57 that is offset downward with respect to base 37 and prevents the PTC modules from falling into interior space 20 once they have been installed.

During assembly, PTC modules are then placed into cavities 55, 56, switching mechanism 19 is placed into interior space 20 in the manner already described, and then cover electrode 12 is put on. Contacting to cover electrode 12 occurs via contact surfaces 58 that are shown with dashed lines in FIG. 3*a*.

Therefore, what I claim, is:

1. A switch for conducting an electrical current, comprising:

a first external terminal and a planar cover electrode having an inner side being connected to said first external terminal, a second external terminal, an insulating support, the first and second external terminals being arranged at said insulating support, a temperature-dependent switching mechanism having a switching member changing its geometric shape in temperature-dependent fashion between a closed position and an open position, and an actuating member having a first end and being connected electrically and mechanically in series with the switching member and being fastened with its first end to the planar cover electrode, such that as a function of its temperature said switching mechanism makes an electrically conductive connection for said current between said first and second external terminals, and a flat series resistor arranged at said inner side of said planar cover electrode and being electrically connected between the first external terminal and the first end of the actuating member.

2. The switch as in claim 1, wherein the actuating member comprises a spring element whose displacing force is largely independent of temperature; and the actuating member has a temperature-dependent displacing force that, in its creep phase, is greater than the displacing force of the spring element.

3. The switch as in claim 2, wherein the spring element and the switching member are substantially flat, sheet-like p arts that extend away from their joining point in a V-shape toward the same side.

4. The switch as in claim 1, wherein there is arranged on the inner side of the cover electrode an insulating film on which is arranged a resistive path that is connected at one end to the first external terminal and at the other end to a contact surface with which a contact region on the spring element is in contact.

5. The switch as in claim 2, wherein there is arranged on the inner side of the cover electrode an insulating film on which is arranged a resistive path that is connected at one end to the first external terminal and at the other end to a contact surface with which a contact region on the spring element is in contact.

6. The switch as in claim 1, wherein the spring element is configured at its first end in a T-shape, rests with that T-shaped end on the insulating support, and has at that T-shaped end a contact region that is in contact with a contact surface of the series resistor.

7. The switch as in claim 2, wherein the spring element is configured at its first end in a T-shape, rests with that T-shaped end on the insulating support, and has at that T-shaped end a contact region that is in contact with a contact surface of the series resistor.

8. The switch as in claim 4, wherein the spring element is configured at its first end in a T-shape, rests with that T-shaped end on the insulating support, and has at that T-shaped end a contact region that is in contact with a contact surface of the series resistor.

9. The switch as in claim 1, wherein the second external terminal is connected to a bottom electrode that coacts with a movable contact element that is provided on the switching member; and at least one PTC module is clamped between the bottom electrode and the cover electrode.

10. The switch as in claim 2, wherein the second external terminal is connected to a bottom electrode that coacts with a movable contact element that is provided on the switching member; and at least one PTC module is clamped between the bottom electrode and the cover electrode.

11. The switch as in claim 4, wherein the second external terminal is connected to a bottom electrode that coacts with a movable contact element that is provided on the switching member; and at least one PTC module is clamped between the bottom electrode and the cover electrode.

12. The switch as in claim 1, wherein the second external terminal is connected to a bottom electrode that coacts with a movable contact element that is provided on the switching member; and a PTC module is clamped between the bottom electrode and a T-shaped end of the spring element.

13. The switch as in claim 2, wherein the second external terminal is connected to a bottom electrode that coacts with a movable contact element that is provided on the switching member; and a PTC module is clamped between the bottom electrode and a T-shaped end of the spring element.

14. The switch as in claim 4, wherein the second external terminal is connected to a bottom electrode that coacts with a movable contact element that is provided on the switching member; and a PTC module is clamped between the bottom electrode and a T-shaped end of the spring element.

15. The switch as in claim 5, wherein the PTC module is arranged in a cavity in the insulating support.

16. The switch as in claim 9, wherein the PTC module is arranged in a cavity in the insulating support.

17. The switch as in claim 12, wherein the PTC module is arranged in a cavity in the insulating support.

18. The switch as in claim 15, wherein the cavity is arranged running transversely between the external terminals.

19. The switch as in claim 15, wherein two lateral cavities are provided next to the switching mechanism.

* * * * *